US005582951A

United States Patent [19]

Patel et al.

[11] Patent Number: 5,582,951

[45] Date of Patent: Dec. 10, 1996

[54] CARRIER PROCESSES

[75] Inventors: Raj D. Patel, Oakville; Grazyna E. Kmiecik-Lawrynowicz, Burlington; Michael A. Hopper, Toronto; Walter Mychajlowskij, Georgetown; Beng S. Ong, Mississauga, all of Canada

[73] Assignee: Xerox Corporation, Stamford, Conn.

[21] Appl. No.: 498,284

[22] Filed: Jul. 3, 1995

[51] Int. Cl.[6] ..... G03G 9/113

[52] U.S. Cl. ..... 430/137; 430/108

[58] Field of Search ..... 430/137, 109, 430/110

[56] References Cited

U.S. PATENT DOCUMENTS

| | | | |
|---|---|---|---|
| 4,983,488 | 1/1991 | Tan et al. | 430/137 |
| 4,996,127 | 2/1991 | Hasegawa et al. | 430/109 |
| 5,346,797 | 9/1994 | Kmiecik-Lawrynowicz et al. | 430/137 |
| 5,403,693 | 4/1995 | Patel et al. | 430/137 |
| 5,482,812 | 1/1996 | Hopper et al. | 430/137 |

*Primary Examiner*—John Goodrow
*Attorney, Agent, or Firm*—E. O. Palazzo

[57] ABSTRACT

A process for the preparation of carrier particles which comprises mixing a dispersion of water, submicron magnetic particles, and ionic surfactant with a latex comprised of resin particles suspended in an aqueous solution containing a surfactant that is counterionic in charge to said ionic surfactant, and a nonionic surfactant; thereafter heating the resulting mixture below about the latex resin glass transition temperature (Tg) while stirring to form aggregates, followed by increasing the temperature of said mixture to about above the latex resin Tg, and subsequently adding additional counterionic or nonionic surfactant solution to minimize, or avoid any further growth in particle size during heating of the mixture about above the latex resin Tg, and wherein said resin Tg is in the range of from between about 45° C. to about 100° C.

27 Claims, No Drawings

CARRIER PROCESSES

BACKGROUND OF THE INVENTION

The present invention is generally directed to carrier processes, and more specifically, to aggregation and coalescence processes for the preparation of carrier particles comprised, for example, of magnetic core particles and polymer particles as a coating. In embodiments, the present invention is directed to the economical in situ chemical preparation of carrier particles with, for example, a particle diameter of from about 20 to about 125, and preferably from about 20 to about 50 microns. The resulting carriers can be selected for known electrophotographic imaging and printing processes, including color processes, and lithography. In embodiments, the present invention is directed to a process comprised of mixing a magnetic pigment solution, especially a submicron magnetic solution and an ionic surfactant solution with a latex mixture comprised of suspended resin particles, preferably resin particles free of acrylic acid or optionally containing, for example, a maximum of about 1 pph of acrylic acid, where the latex particles are of a size in the range of 0.01 micron to about 1 micron in volume average diameter in an aqueous solution containing a counterionic surfactant in amounts of from about 1 percent to about 10 percent with opposite charge to the ionic surfactant of the pigment dispersion, and nonionic surfactant in an amount of from 0 percent to about 5 percent, followed by blending at speeds of about 3,000 to 5,000 rpm using a polytron, thereby causing a flocculation of the resin particles and pigment particles, followed by heating just below the resin Tg while stirring the resulting flocculent mixture to obtain aggregates of a size of from about 8 to 15 microns, and then gently heating the mixture, for example, in increments of 2° to 3° C. at a time at the rate of 0.25° C. per minute, above the latex resin glass transition temperature (Tg), which Tg is in the range of from between about 45° C. to about 100° C. and preferably between about 50° C. and about 90° C., while monitoring the increase in particle size, and thereafter, adding in an effective amount of, for example, 0 to 70 milliliters of 20 percent (w/w of water) extra anionic or nonionic surfactant solution with a concentration of from about 5 percent to about 30 percent, which will result in an overall final concentration of this surfactant in the aggregated mixture of from about 0.5 percent to about 10 percent, and preferably from 1 percent to 5 percent (weight percent throughout unless otherwise indicated) to thereby enable any further growth in particle size during further heating, which size in embodiments is from about 20 to about 50 microns in average volume diameter; and more preferably the resin Tg is equal to 58° C., to generate carrier with an average particle volume diameter of from about 20 to about 50 microns, and wherein in embodiments the stirring speed can be reduced from about 300 to about 1,000 to about 100, and preferably 150, to about 600 revolutions per minute to enable carrier particles comprised of magnetic particles encapsulated in, encased in, or coated with a polymer resin. In embodiments, the latex selected is synthesized by emulsion polymerization processes in an aqueous phase containing anionic and nonionic surfactants, and persulfate as an initiator. Thereafter, the resulting anionicly charged latex is mixed with a pigment solution containing the pigment magnetite at, for example, from about 40 to about 75 weight percent, and a cationic surfactant, such as alkylbenzyldimethyl ammonium chloride, and which mixture is polytroned at high speeds, for example from 5,000 to 10,000 revolutions per minute, to obtain a stable dispersion comprised of resin particles, pigment particles, water, anionic, nonionic, and cationic surfactants. Subsequently, the dispersion obtained is aggregated at a temperature of about 50° C. or higher, for example in the range of from about 50 to about 70° C. The aggregate size obtained when heated to 50 to 54° C. is normally in the range of 8 to 12 microns with a narrow GSD, for example 1.24. The temperature is then gently raised above the resin Tg in increments of 2° to 3° C. in stages, and the particle size monitored. The particle size growth is accelerated when the temperature is raised above the resin Tg. As the temperature differential gets larger, the larger the particle size of the carrier. Upon approaching the desired particle size, there is added an anionic surfactant solution to primarily decrease and stop the growth of the aggregate particles when the temperature is further increased in the coalescence step. Without any or little, for example 0.5 pph, acrylic acid on the particle surface, the particles tend to grow and coalesce quicker and at a lower temperature as compared to aggregates containing acrylic acid. It is believed that during the second heating stage the components of aggregated particles fuse together to form carrier particles. Specifically, the carrier particles are prepared by first dispersing submicron magnetic particles, such as NP 604™, 608™, 628™(from Northern Pigments), in an aqueous mixture containing a cationic surfactant, such as benzalkonium chloride (SANIZOL B-50™), utilizing a high shearing device, such as a Brinkmann Polytron, or microfluidizer or sonicator, thereafter shearing this mixture with a charged latex of suspended resin particles, such as poly(styrene/butadiene/acrylic acid), poly(styrene/butylacrylate/acrylic acid) or PLIOTONE™ of poly(styrene butadiene), and of particle size ranging from about 0.01 to about 0.5 micron as measured by the Brookhaven nanosizer in an aqueous surfactant mixture containing an anionic surfactant, such as sodium dodecylbenzene sulfonate, for example NEOGEN R™ or NEOGEN SC™, and nonionic surfactant, such as alkyl phenoxy poly(ethylenoxy) ethanol, for example IGEPAL 897™ or ANTAROX 897™, thereby resulting in a flocculation, or heterocoagulation of the resin particles with the magnetic pigment particles; and which upon heating at from about 2° to about 10° C. below the resin Tg, which Tg is in the range of between 50° to 90° C. and preferably between about 55° and 80° C. and for a period of 1 to 6 hours and preferably for a period of 2 to 5 hours, results in formation of statically bound aggregates ranging in size of from about 8 microns to about 15 microns in average diameter size as measured by the Coulter Counter (Microsizer II) while stirring, the stirring in the range of 300 to 1,000 rpm and preferably in the range of 200 to 700 rpm. The temperature is further raised above the resin Tg in incremental steps of 2° to 3° C. and held for a period of at least 1 hour and preferably for a period of 0.5 hour while the particle size is monitored during every incremental step. The higher the temperature, the larger the particle size; and adding concentrated (from about 5 percent to about 30 percent) aqueous surfactant solution containing an anionic surfactant, such as sodium dodecylbenzene sulfonate, for example NEOGEN R™ or NEOGEN SC™, or nonionic surfactant, such as alkyl phenoxy poly(ethylenoxy) ethanol, for example IGEPAL 897™ or ANTAROX 897™, in controlled amounts (from about 5 percent to about 30 percent) to prevent any changes in particle size upon reaching the desired size, for example 30 microns to the mixture to prevent any growth of the aggregates. The temperature is further raised to 90° C. to complete the coalescence of magnetic particles and resin, wherein the coalescence temperature is in the range of 75° to 130° C. and preferably in the range of 80° to 120° C., and wherein the carrier particle size obtained is in the range of 20 to 75 microns and preferably in the range of 25 to 60 microns with a narrow GSD of 1.26; followed by washing with, for example, hot water to remove surfactants, and drying whereby particles comprised of resin and magnetite of synthetic carrier particles are obtained.

Numerous processes are known for the preparation of carriers, for example solution and dry coating methods as illustrated in U.S. Pat. Nos. 4,937,166, and 4,935,326. In these methods, carrier core such as iron, or steel is heated with a polymer coating, or coatings until adherence of the coating to the core.

There is illustrated in U.S. Pat. No. 4,996,127 a toner of associated particles of secondary particles comprising primary particles of a polymer having acidic or basic polar groups, and a coloring agent. The polymers selected for the toners of this '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. Also, note column 9, lines 50 to 55, wherein a polar monomer, such as acrylic acid, in the emulsion resin is necessary, and toner preparation is not obtained without the use, for example, of an acrylic acid polar group, see Comparative Example I. The aforementioned patent does not disclose the preparation of carrier particles. In U.S. Pat. No. 4,983,488, there is illustrated a process for the preparation of toners by the polymerization of a polymerizable monomer dispersed by emulsification in the presence of a colorant and/or a magnetic powder to prepare a principal resin component, and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70 are obtained. This process is thus primarily directed to the use of coagulants, such as inorganic magnesium sulfate which results in the formation of particles with wide GSD. The aforementioned patent does not disclose the preparation of synthetic carrier particles.

In U.S. Pat. No. 5,403,693, there is illustrated a process for the preparation of toner compositions with controlled particle size comprising:

(i) preparing a pigment dispersion in water, which dispersion is comprised of a pigment, an ionic surfactant in amounts of from about 0.5 to about 10 percent by weight of water, and an optional charge control agent;

(ii) shearing the pigment dispersion with a latex mixture comprised of a counterionic surfactant with a charge polarity of opposite sign to that of said ionic surfactant, a nonionic surfactant, and resin particles, thereby causing a flocculation or heterocoagulation of the formed particles of pigment, resin, and charge control agent;

(iii) stirring the resulting sheared viscous mixture of (ii) at from about 300 to about 1,000 revolutions per minute to form electrostatically bound substantially stable toner size aggregates with a narrow particle size distribution;

(iv) reducing the stirring speed in (iii) to from about 100 to about 600 revolutions per minute, and subsequently adding further anionic or nonionic surfactant in the range of from about 0.1 to about 10 percent by weight of water to control, prevent, or minimize further growth or enlargement of the particles in the coalescence step (iii); and (v) heating and coalescing from about 5° to about 50° C. above about the resin glass transition temperature, Tg, which resin Tg is from between about 45° C. to about 90° C. and preferably from between about 50° C. and about 80° C., the statically bound aggregated particles to form said toner composition comprised of resin, pigment and optional charge control agent.

Emulsion/aggregation processes for the preparation of toners are illustrated in a number of Xerox patents, the disclosures of which are totally incorporated herein by reference, such as U.S. Pat. No. 5,290,654, U.S. Pat. No. 5,278,020, U.S. Pat. No. 5,308,734, U.S. Pat. No. 5,346,797, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797.

SUMMARY OF THE INVENTION

It is an object of the present invention to provide a process for the preparation of synthetic carrier particles by emulsion aggregation process, and wherein there can be obtained small, 20 to 50 micron carrier particles, and wherein conventional breakdown of magnetic particles is avoided. Moreover, as toner particles become smaller the need for smaller carrier is greater.

In another object of the present invention there are provided simple and economical processes for the direct preparation of synthetic carrier particles comprised of magnetic particles.

In yet another object of the present invention there are provided emulsion/aggregation processes for the preparation of carrier particles with a controlled size of, for example, from about 20 to about 75, and preferably from about 20 to about 50 microns in diameter, and which carrier particles can be coated with a polymer, or mixture of polymers, and wherein in embodiments the amount of the surfactant used for "freezing" the carrier particle size can be accomplished at a temperature of 55° C. for 2.5 hours while being stirred at 500 rpm. The mixture temperature is then raised above the resin Tg in increments of 2° to 3° C. and held there for at least 0.5 hour, and the particle size monitored until the desired particle size is obtained. The stirring speed can be reduced from 550 to 250 rpm, and then upon reaching the desired particle size 45 milliliters of 20 percent anionic surfactant can be added to prevent any further growth, and the temperature raised to 90° C. and held there for 3 hours to coalesce the aggregates to form the carrier particles.

These and other objects of the present invention are accomplished in embodiments by the provision of emulsion/aggregation processes for the preparation of carrier particles, especially synthetic carrier particles comprised of magnetic particles, such as a mixture of iron oxides. In embodiments, the present invention is directed to a process comprised of mixing a pigment solution, especially submicron magentic particles and an ionic surfactant in water with a latex mixture comprised of suspended resin particles containing a maximum of 1 pph of acrylic acid and preferably resin particles free of acrylic acid in an aqueous solution containing a counterionic surfactant in effective amounts of, for example, from about 1 percent to about 10 percent with opposite charge to the ionic surfactant of the pigment dispersion, and nonionic surfactant in effective amounts of, for example, from 1 percent to about 5 percent, thereby causing a flocculation of the resin particles, and pigment particles, followed by heating below the resin Tg while stirring of the resulting flocculent mixture for a period of at least 2 hours, followed by raising the mixture temperature in small increments, while monitoring the particle size growth, and thereafter, upon reaching the desired particle size the addition of extra anionic or nonionic surfactant solution to thereby enable any further growth in particle size during the heating step, which size in embodiments is from about 25 to about 50 microns in average volume diameter; and then further heating the mixture to generate synthetic carrier with an average particle volume diameter of from about 20 to about 45 microns. In embodiments of the present invention, there are provided processes for the economical direct preparation of carrier compositions by flocculation or heterocoagulation, and coalescence processes, and wherein the stirring speeds and the amount of cationic surfactant selected can be utilized to control the final carrier particle size, that is average volume diameter.

In embodiments, the present invention is directed to a process for the preparation of carrier particles which comprises mixing a dispersion of water, submicron magnetic particles, and ionic surfactant with a latex comprised of resin particles suspended in an aqueous solution containing a surfactant that is counterionic in charge to said ionic surfactant, and a nonionic surfactant; thereafter heating the resulting mixture below about the latex resin glass transition temperature (Tg) while stirring to form aggregates, followed by increasing the temperature of the mixture to above the latex resin Tg, and subsequently adding additional counterionic or nonionic surfactant solution to minimize, or avoid any further growth in particle size during heating of the mixture above about the latex resin Tg, and wherein said resin Tg is in the range of from between about 45° C. to about 100° C.; and processes for the preparation of synthetic carrier compositions which comprise initially attaining or generating an ionic pigment dispersion, for example dispersing an aqueous mixture of a pigment, such as submicron MAPICO BLACK™, with a cationic surfactant, such as benzalkonium chloride, by utilizing a high shearing device, such as a Brinkmann Polytron; thereafter shearing this mixture by utilizing a high shearing device, such as a Brinkmann Polytron, a sonicator or a microfluidizer, with a suspended resin mixture comprised of polymer particles, such as poly(styrene butadiene) or poly(styrene butylacrylate), which may contain little (up to a maximum of 1 pph) of acrylic acid or no acrylic acid, and of particle size ranging from 0.01 to about 0.5 micron in an aqueous surfactant mixture containing an anionic surfactant, such as sodium dodecylbenzene sulfonate and nonionic surfactant, resulting in a flocculation, or heterocoagulation of the resin particles with the pigment particles caused by the neutralization of anionic surfactant absorbed on the resin particles with the oppositely charged cationic surfactant absorbed on the pigment particle; followed by heating below the resin Tg while stirring the resulting flocculent mixture using a mechanical stirrer at 300 to 800 rpm for a period of at least about 2 hours, allowing the formation of electrostatically stabilized aggregates ranging from about 8 microns to about 14 microns, followed by raising the mixture temperature in 2° to 3° C. increments at the rate of 0.25° C./minute, while monitoring the particle size growth, and thereafter, upon reaching the desired particle size the addition of extra anionic or nonionic surfactant solution to "freeze" the aggregate size, thereby enable any further growth in particle size during the heating step, which size in embodiments is from about 25 to about 50 microns in average volume diameter; and then further heating the mixture to provide for particle fusion or coalescence of the polymer and pigment particle, thereby generating synthetic carrier with an average particle volume diameter of from about 20 to about 45 microns.

Illustrative examples of resin particles selected for the process of the present invention include known thermoplastics, such as polymers like poly(styrene-butadiene), poly(para-methyl styrene-butadiene), poly(metamethyl styrene-butadiene), poly(alpha-methyl styrene-butadiene), poly(methylmethacrylate-butadiene), poly(ethylmethacrylate-butadiene), poly(propylmethacrylate-butadiene), poly(butylmethacrylate-butadiene), poly(methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(metamethyl styrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene); terpolymers such as poly(styrene-butadiene-acrylic acid), poly(styrene-butadiene-methacrylic acid), PLIOTONE™ available from Goodyear, polyethylene-terephthalate, polypropylene-terephthalate, polybutyleneterephthalate, polypentylene-terephthalate, polyhexalene-terephthalate, polyheptadene-terephthalate, polyoctalene-terephthalate, POLYLITE™ (Reichhold Chemical Inc), PLASTHALL™ (Rohm & Hass), CYGAL™ (American Cyanamide), ARMCO™ (Armco Composites), CELANEX™ (Celanese Eng), RYNITE™ (DuPont), STYPOL™, and the like. The resin selected generally can be in embodiments styrene acrylates, styrene butadienes, styrene methacrylates, or polyesters present in various effective amounts, such as from about 85 weight percent to about 98 weight percent of the toner, and can be of small average particle size such as from about 0.01 micron to about 1 micron in average volume diameter as measured by the Brookhaven nanosize particle analyzer.

The resin selected for the latex of the present invention can be prepared by emulsion polymerization techniques, and the monomers utilized in such processes can be styrene, acrylates, methacrylates, butadiene, isoprene, and optionally acid or basic olefinic monomers, such as acrylic acid, methacrylic acid, itaconic acid, acrylamide, methacrylamide, quaternary ammonium halide of dialkyl or trialkyl acrylamides or methacrylamide, vinylpyridine, vinylpyrrolidone, vinyl-N-methylpyridinium chloride, and the like. The presence of acid or basic groups is optional and such groups can be present in various amounts of from about 0.1 to about 10 percent by weight of the polymer resin. Known chain transfer agents, such as dodecanethiol or carbon tetrabromide, butanethiol and the like, can also be selected when preparing resin particles by emulsion polymerization. Other processes for obtaining resin particles of from about 0.01 micron to about 3 microns can be selected from polymer microsuspension process, such as disclosed in U.S. Pat. No. 3,674,736, the disclosure of which is totally incorporated herein by reference.

Surfactants in amounts of, for example, 0.1 to about 25 weight percent in embodiments include, for example, nonionic surfactants such as dialkylphenoxypoly(ethyleneoxy) ethanol such as IGEPAL CA-210™, IGEPAL CA-520™, IGEPAL CA-720~, IGEPAL CO-890™, IGEPAL CO-720™, IGEPAL CO-290™, IGEPAL CA-210™, ANTAROX 890™, ANTAROX 897™, and the like. An effective concentration of the nonionic surfactant is, for example, from about 0.01 to about 10 percent by weight, and preferably from about 0.1 to about 5 percent by weight of monomers used to prepare the copolymer resin.

Examples of ionic surfactants include anionic and cationic, and examples of anionic include surfactants selected for the processes of the present invention which are, for example, sodium dodecyl sulfate (SDS), sodium dodecylbenzene sulfonate, sodium dodecylnaphthalene sulfate, dialkyl benzenealkyl, sulfates and sulfonates, abitic acid available from Aldrich, NEOGEN R™, NEOGEN SC™ available from Kao, and the like. An effective concentration of the anionic surfactant generally employed is, for example, from about 0.01 to about 10 percent by weight, and preferably from about 0.1 to about 5 percent by weight.

Examples of the cationic surfactants selected for the processes of the present invention are, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like, and mixtures thereof. This surfactant is utilized in various effective amounts, such as for example from about 0.1 percent to about 5 percent by weight of water. Preferably the molar ratio of the cationic surfactant used for flocculation to the anionic surfactant used in the latex preparation is in the range of about 0.5 to 4, and preferably from about 0.5 to 2.

Examples of the surfactant, which are added to the aggregated particles to "freeze" or retain particle size, achieved in the aggregation can be selected from the anionic surfactants, such as sodium dodecylbenzene sulfonate, sodium dodecylnaphthalene sulfate, dialkyl benzenealkyl, sulfates and sulfonates available from Aldrich, NEOGEN R™ NEOGEN SC™ from Kao, and the like. These surfactants also include nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™.

An effective concentration of the anionic or nonionic surfactant generally employed in embodiments as a "freezing agent" or stabilizing agent is, for example, from about 0.01 to about 30 percent by weight, and preferably from about 0.5 to about 5 percent by weight of the total weight of the aggregated mixture.

Illustrative examples of magnetic core particles selected for the present invention include magnetites generally, and more specifically, MAPICO BLACK®, MAPICO RED®, MAPICO BROWN®, MAPICO TAN®, all of iron composition available from Columbian Chemicals, Bayferrox 8600, Bayferrox 8610, Bayferrox ER 3040, Bayferrox ER 3043, Bayferrox PK 5184, all from Mobay, MAGNOX TMB50™ MAGNOX TMB 100™, MAGNOX TMB100™, MAGNOX TMB 100S™, MAGNOX TMB 100X™, all available from Magnox Corporation, NP 604™, NP 608™, NP612™, all available from Northern Pigments, MO 2230™, MO 7029™, MO 8029™, MO 4431™, MO 4232™, TB 5600™, TB 5800,™, CX 6368™, CX 6241™, all available from Pfizer Chemicals, SICOPUR 4068 FF™ from BASF, METGLAS™ and ULTRAFINE METGLAS™, from Allied Company, CARBONYLIRON SF™ from GAF; nickel powder; chromium powder; manganese ferrites; and the like. The preferred average diameter particle size of the magnetic materials is from about 0.2 to less than 1 micron.

The following Examples are being submitted to further define various species of the present invention. These Examples are intended to be illustrative only and are not intended to limit the scope of the present invention. Also, parts and percentages are by weight unless otherwise indicated.

EXAMPLE I

Latex Preparation (A):

A polymeric latex was prepared by emulsion polymerization of styrene/butylacrylate, 82/18 parts (by weight), in nonionic/anionic surfactant solution (3 percent) as follows. 1,312 Grams of styrene, 288 grams of butylacrylate, and 48 grams of dodecanethiol were mixed with 2,400 milliliters of deionized water in which 36 grams of sodium dodecyl benzene sulfonate anionic surfactant (NEOGEN R™ which contains 60 percent of active component), 34.4 grams of polyoxyethylene nonyl phenyl ether—nonionic surfactant (ANTAROX 897 ™—70 percent active), and 16 grams of ammonium persulfate initiator were dissolved. The emulsion was then polymerized at 70° C. for 6 hours. The resulting latex contained 60 percent of water and 40 percent of solids of the styrene butylacrylate copolymer 82/18; the Tg of the latex dry sample was 55° C., as measured on a DuPont DSC; $M_w$=24,000, and $M_n$=7,800, as determined on a Hewlett Packard GPC. The zeta potential as measured on a Pen Kem Inc. Laser Zee Meter was −90 millivolts. The particle size of the latex as measured on Brookhaven BI-90 Particle Nanosizer was 179 nanometers. The aforementioned latex was then selected for carrier preparation.

Latex Preparation (B):

A polymeric latex was prepared by emulsion polymerization of styrene/butylacrylate/acrylic acid, 82/18/0.5 parts (by weight), in nonionicanionic surfactant solution (3 percent) as follows. 1,312 grams of styrene, 288 grams of butylacrylate, 8 grams of acrylic acid and 48 grams of dodecanethiol were mixed with 2,400 milliliters of aleionized water in which 36 grams of sodium dodecyl benzene sulfonate anionic surfactant (NEOGEN R™ which contains 60 percent of active component), 34.4 grams of polyoxyethylene nonyl phenyl ether—nonionic surfactant (ANTAROX 897™—70 percent active), and 16 grams of ammonium persulfate initiator were dissolved. The emulsion was then polymerized at 70° C. for 6 hours. The resulting latex contained 60 percent of water and 40 percent of solids of the styrene butylacrylate copolymer, 82/18; the Tg of the latex dry sample was 54.5° C., as measured on a DuPont DSC; $M_w$=25,050, and $M_n$=7,600, as determined on a Hewlett Packard GPC. The zeta potential as measured on a Pen Kem Inc. Laser Zee Meter was −90 millivolts. The particle size of the latex as measured on a Brookhaven BI-90 Particle Nanosizer was 165 nanometers. The aforementioned latex was then selected for the carrier preparation as indicated herein.

Preparation of Particles: (35 microns)

160 Grams of dry MAPICO BLACK® pigment were dispersed in 240 milliliters of aleionized water containing 2.3 grams of alkylbenzyldimethyl ammonium chloride cationic surfactant (SANIZOL B™) by a polytron at 3,000 rpm for a period of 3 minutes. This cationic dispersion of the pigment was than simultaneously added with 260 grams of Latex A to 400 grams of water while being homogenized with an IKA G45M probe for 3 minutes at 7,000 rpm. The resulting mixture was then transferred into a reaction kettle, and its temperature raised to 50° C. and held there for a period of 2 hours. The particle size of the aggregate obtained was 7.2 microns with a GSD of 1.22 as measured by a Coulter Counter. The temperature was then raised to 53° C. at the rate of 0.25° C./minute and held there for a period of 30 minutes, and the particle size measured was now 11 microns with a GSD of 1.22. The reactor temperature was further raised by another 3° C., for example 56° C., at the rate of 0.25° C./minute and held there for 1 hour. The particle size measured was 19.0 microns. The temperature was then raised in 3° C. increments again at the rate of 0.25° C./minute to a temperature of 62° C. and held there for a period of 1 hour. The particle size measured was 34 microns with a GSD of 1.25. Sixty (60) milliliters of 20 percent (W/W) anionic surfactant solution were added to the formed aggregates, in order to stabilize them, after which the reactor temperature was raised to 85° C. for 2 hours to complete the coalescence of the aggregates. The final particle size obtained was 35 microns with a GSD of 1.25. These particles, when observed under an optical miscroscope, showed a smooth surface morphology. The particles were then washed with aleionized water and freeze dried. The resulting carrier particles were comprised of 40 (percent) resin of poly(styrene-cobutylacrylate) coated over a core containing 60 percent of magnetic MAPICO BLACK®.

EXAMPLE II

Preparation of Particles: (23 microns)

The carrier particles were prepared as follows. 160 Grams of dry MAPICO BLACK® pigment were dispersed in 240 milliliters of deionized water containing 2.3 grams of alkylbenzyldimethyl ammonium chloride cationic surfactant (SANIZOL B™) by a polytron at 3,000 rpm for a period of 3 minutes. This cationic dispersion of the pigment was than simultaneously added with 260 grams of Latex A to 400 grams of water while being homogenized with an IKA G45M probe for 3 minutes at 7,000 rpm. The resulting mixture was then transferred into a reaction kettle, and its temperature raised to 50° C. and held there for a period of 2 hours. The particle size of the aggregate obtained was 7.5 microns with a GSD of 1.23 as measured by a Coulter Counter. The temperature was then raised to 56° C. at the rate of 0.25° C./minute and held there for a period of 1 hour. The particle size measured was 18.7 microns with a GSD of 1.24. The temperature was then further raised to 58° C. at the rate of 0.25° C./minute, and held there for a period of 1 hour. The particle size measured was 22 microns with a GSD of 1.24. Sixty (60) milliliters of 20 percent (W/W) anionic surfactant solution were added to the formed aggregates, in order to stabilize them, after which the reactor temperature was raised to 85° C. for 2 hours to complete the coalescence of the aggregates. The final particle size obtained was 23 microns with a GSD of 1.25. These particles, when observed under an optical miscroscope, showed a smooth surface morphology. The particles were then washed with aleionized water and freeze dried. The resulting particles were comprised of 40 (percent) resin of poly(styrene-co-butylacrylate) coated over a core containing 60 percent of magnetic MAPICO BLACK™.

EXAMPLE III

Preparation of Particles: (47 microns):

160 Grams of dry MAPICO BLACK™ pigment were dispersed in 240 milliliters of deionized water containing 2.3 grams of alkylbenzyldimethyl ammonium chloride cationic surfactant (SANIZOL B™) by a polytron at 3,000 rpm for a period of 3 minutes. This cationic dispersion of the pigment was then simultaneously added with 260 grams of Latex A to 400 grams of water while being homogenized with an IKA G45M probe for 3 minutes at 7,000 rpm. The resulting mixture was then transferred into a reaction kettle, and its temperature raised to 50° C. and held there for a period of 2 hours. The particle size of the aggregate obtained was 7.6 microns with a GSD of 1.23 as measured by a Coulter Counter. The temperature was then raised to 56° C. at the rate of 0.25° C./minute and held there for a period of 1 hour, and the particle size measured was now 19.3 microns with a GSD of 1.24. The temperature was then raised in 3° C. increments again at the rate of 0.25° C. minute to a temperature of 62° C. and held there for a period of 1 hour. The particle size measured was 34.6 microns with a GSD of 1.24. The reactor temperature was then further raised to 65° C. at the rate of 0.25° C./minute and held there for a period of 0.5 hour. The particle size measured was 44 microns. Seventy (70) milliliters of 20 percent (W/W) anionic surfactant solution were added to the formed aggregates, in order to stabilize them, after which the reactor temperature was raised to 85° C. for 2 hours to complete the coalescence of the aggregates. The final particle size obtained was 47 microns with a GSD of 1.26. These particles, when observed under an optical miscroscope, showed a smooth surface morphology. The particles were then washed with deionized water and freeze dried. The resulting particles comprised of 40 (percent) resin of poly(styrene-co-butylacrylate) coated over a core containing 60 percent of magnetic MAPICO BLACK™.

EXAMPLE IV

Preparation of Particles: (60 microns)

The procedure was the same as in Example III except that the amount of anionic surfactant added to stabilize was reduced by 66 percent, for example 23 milliliters. The particle size grew from 45 microns to 59 microns in size upon raising the reactor temperature to 85° C. to complete the coalescence step. The GSD was 1.30 which was broader than Examples I, II and III.

Although final particle size is not fully controlled in this Example, the Example does indicate that one can obtain larger particles by using less anionic stabilizer if narrow GSD is not an important requirement.

EXAMPLE V

Preparation of Particles: (23 microns)

160 Grams of dry MAPICO BLACK® pigment were dispersed in 240 milliliters of deionized water containing 2.3 grams of alkylbenzyldimethyl ammonium chloride cationic surfactant (SANIZOL B™) by a polytron at 3,000 rpm for a period of 3 minutes. This cationic dispersion of the pigment was than simultaneously added with 260 grams of Latex B to 400 grams of water while being homogenized with an IKA G45M probe for 3 minutes at 7,000 rpm. The resulting mixture was then transferred into a reaction kettle, and its temperature raised to 50° C. and held there for a period of 2 hours. The particle size of the aggregate obtained was 7.0 microns with a GSD of 1.20 as measured by a Coulter Counter. The temperature was then raised to 53° C. at the rate of 0.25° C./minute and held there for a period of 30 minutes, and the particle size measured was now 9.8 microns with a GSD of 1.20. The reactor temperature was raised to 56° C. at the rate of 0.25° C./minute and held there for another 30 minutes. The particle size measured was 12.1 microns with a GSD of 1.21. After another 30 minutes at 53° C., the particle size was 14.8 microns. The temperature was then raised to 62° C. at the rate of 0.25° C./minute and held there for a period of 1 hour. The particle size measured was 22 microns with a GSD of 1.23. Sixty (60) milliliters of 20 percent (W/W) anionic surfactant solution were added to the formed aggregates, in order to stabilize them, after which the reactor temperature was raised to 85° C. for 2 hours to complete the coalescence of the aggregates. The final particle size obtained was 23 microns with a GSD of 1.23. These carrier particles, when observed under an optical miscroscope, showed a smooth surface morphology. The particles were then washed with deionized water and freeze dried. The resulting particles were comprised of poly(styrene-co-butylacrylate) coated over a core containing 60 percent of magnetic MAPICO BLACK™.

Other embodiments and modifications of the present invention may occur to those skilled in the art subsequent to a review of the information presented herein; these embodiments and modifications, as well as equivalents thereof, are also included within the scope of this invention.

What is claimed is:

1. A process for the preparation of carrier particles which consists essentially of mixing a dispersion of water, submicron magnetic particles, and ionic surfactant with a latex comprised of resin particles suspended in an aqueous solution containing a surfactant that is counterionic in charge to said ionic surfactant, and a nonionic surfactant; thereafter heating the resulting mixture below about the latex resin glass transition temperature (Tg) while stirring to form aggregates, followed by increasing the temperature of said mixture to about above the latex resin Tg, and subsequently adding additional counterionic or nonionic surfactant solution to minimize, or avoid any further growth in particle size during heating of the mixture about above the latex resin Tg, and wherein said resin Tg is in the range of from between about 45° C. to about 100° C.

2. A process in accordance with claim 1 wherein said submicron is from about 0.2 to about 0.8 micron, and said additional counterionic or nonionic surfactant is selected in an amount of from about 1 to about 10 weight percent.

3. A process in accordance with claim 1 wherein said counterionic surfactant is an anionic surfactant, and wherein increasing the temperature of said mixture to above the latex resin Tg controls the size diameter of the carrier particles.

4. A process in accordance with claim 1 wherein said resin particles are free of acrylic acid, or wherein said resin particles contain up to about 1 part per hundred (pph) of acrylic acid.

5. A process in accordance with claim 1 wherein the counterionic surfactant is selected in amounts of from about 1 percent to about 10 percent; the nonionic surfactant is selected in an amount of from about 1 percent to about 5 percent, and the diameter of the carrier particles are from about 20 to about 125 microns.

6. A process in accordance with claim 1 wherein the diameter of the carrier particles formed is from about 20 to about 75 microns.

7. A process in accordance with claim 1 wherein the mixture is sheared at high speeds of from about 5,000 to about 10,000 revolutions per minute.

8. A process in accordance with claim 1 wherein the mixture is stirred at from about 300 to about 1,000 revolutions per minute, followed by reducing the stirring speed to from about 100 to about 600 revolutions per minute, and subsequently adding further counterionic, or nonionic surfactant in the range of from about 0.1 to about 10 percent by weight of water to control, prevent, or minimize further growth or enlargement of the carrier particles during heating when heating the mixture above about the latex resin Tg, which Tg is in the range of from about 45° C. to about 100° C.

9. A process in accordance with claim 1 wherein the surfactant utilized in preparing the magnetic dispersion is a cationic surfactant selected in an amount of from about 0.01 percent to about 10 percent, and the anionic surfactant present in the latex mixture is an anionic surfactant present in an amount of from about 0.2 percent to about 5 percent; and wherein the molar ratio of cationic surfactant introduced with the magnetic dispersion to the anionic surfactant introduced with the latex is from about 0.5 to about 5 weight percent.

10. A process in accordance with claim 1 wherein the addition of further anionic surfactant stabilizes the aggregated particles and as a result fixes their size and particle size distribution, and wherein the particle size is in the range of from about 20 to about 75 microns in average volume diameter.

11. A process in accordance with claim 1 wherein the nonionic surfactant utilized for controlling particle growth is an alkyl phenoxypoly(ethyleneoxy) ethanol.

12. A process in accordance with claim 3 wherein slowly is from about 30 seconds to about 25 minutes.

13. A process in accordance with claim 1 wherein the mixing is accomplished by homogenizing at from about 1,000 revolutions per minute to about 10,000 revolutions per minute at a temperature of from about 25° C. to about 35° C., and for a duration of from about 1 minute to about 120 minutes.

14. A process in accordance with claim 1 wherein the resin particles are thermoplastic resins selected from the group consisting of poly(styrene-butadiene), poly(para-methyl styrene-butadiene), poly(metamethyl styrene-butadiene), poly(alpha-methylstyrene-butadiene), poly(methylmethacrylate-butadiene), poly(ethylmethacrylate-butadiene), poly(propylmethacrylate-butadiene), poly(butylmethacrylate-butadiene), poly(methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(metamethyl styrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene).

15. A process in accordance with claim 1 wherein the nonionic surfactant is selected from the group consisting of polyvinyl alcohol, methalose, methyl cellulose, ethyl cellulose, propyl cellulose, hydroxy ethyl cellulose, carboxy methylcellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy) ethanol.

16. A process in accordance with claim 1 wherein the counterionic surfactant is an anionic surfactant selected from the group consisting of sodium dodecyl sulfate, sodium dodecylbenzene sulfate and sodium dodecylnaphthalene sulfate.

17. A process in accordance with claim 3 wherein the anionic surfactant concentration is about 0.1 to about 5 weight percent of the aqueous phase, and the cationic surfactant concentration is about 0.1 to about 5 weight percent of the aqueous phase.

18. A process in accordance with claim 1 wherein the carrier particles are washed with water and the surfactants are removed therefrom, followed by drying.

19. A process in accordance with claim 1 wherein the carrier particles are comprised of a core of magnetic particles, and polymer coating thereover comprised of resin particles.

20. A process for preparation of synthetic carrier particles comprised of a core of magnetic particles and polymer coating comprised of resin particles, which process comprises mixing a dispersion of water, submicron magnetic particles, and ionic surfactant with a latex comprised of resin particles suspended in an aqueous solution containing a surfactant, that is counterionic in charge to said ionic surfactant, and a nonionic surfactant; and wherein said mixing is optionally accomplished at high speeds with a polytron; heating and stirring the resultant flocculent mixture to a temperature below the resin Tg to obtain aggregates of about 8 to 15 microns in size; followed by increasing the mixture temperature above the latex resin Tg and monitoring the particle size increase; followed by the addition of anionic or nonionic surfactant solution upon reaching the desired carrier particle size thereby preventing any further growth in the particle size; maintaining the heating temperature for an additional period of about 0.5 hour to about 3 hours to form composite carrier particles comprised of a core of magnetite and polymer resin coating, and wherein said carrier particles are of a size diameter in the range of from about 20 to about 50 microns; followed by cooling to about room temperature and washing the carrier particles with water to remove the surfactants, and thereafter optionally drying said carrier particles.

21. A process in accordance with claim 1 wherein said magnetic particles are comprised of a magnetite.

22. A process in accordance with claim 1 wherein said magnetic particles are cobalt, iron, cobalt-iron alloys, a cobalt alloy wherein said alloy is a metal of nickel, chromium, vanadium, manganese, magnesium, molybdenum, lead, titanium, copper, aluminum, zirconium, chromium, platinum, tungsten, gold, berylium, or rare earth metals, and an iron alloy wherein said alloy is a metal of nickel, chromium, vanadium, manganese, magnesium, molybdenum, lead, titanium, copper, aluminum, zirconium, chromium, platinum, tungsten, gold, berylium; or rare earth metals.

23. A process in accordance with claim 1 wherein said magnetic particles are comprised of magnetites, and wherein submicron is from about 0.2 to about 0.8 micron in diameter.

24. A process in accordance with claim 1 wherein said mixing of said dispersion of water, submicron magnetic particles, and ionic surfactant with a latex comprised of resin particles suspended in an aqueous solution is accomplished with a high speed blending device.

25. A process in accordance with claim 24 wherein said high is from about 5,000 to about 10,000 revolutions per minute.

26. A process in accordance with claim 20 wherein the magnetic particles are comprised of a magnetite.

27. A process for the preparation of carrier particles which comprises mixing a dispersion of water, submicron magnetic particles, and ionic surfactant with a latex comprised of resin particles suspended in an aqueous solution containing a surfactant that is counterionic in charge to said ionic surfactant, and a nonionic surfactant; thereafter heating the resulting mixture below about the latex resin glass transition temperature (Tg) while stirring to form aggregates, followed by increasing the temperature of said mixture to about above the latex resin Tg, and subsequently adding additional counterionic or nonionic surfactant solution to minimize, or avoid any further growth in particle size during heating of the mixture about above the latex resin Tg, and wherein said resin Tg is in the range of from between about 45° C. to about 100° C., and wherein the diameter of the carrier particles is from about 20 to about 75 microns and said submicron magnetic particles are of a size of from about 0.2 to about 8 microns in diameter.

* * * * *